US005838356A

United States Patent [19]

Günther et al.

[11] Patent Number: 5,838,356

[45] Date of Patent: Nov. 17, 1998

[54] PRINT HEAD THERMOCONTROL

[75] Inventors: Stephan Günther, Berlin; Dieter Wölm, Gross Schulzendorf, both of Germany

[73] Assignee: Francotyp-Postalia AG & Co., Birkenwerder, Germany

[21] Appl. No.: 609,950

[22] Filed: Mar. 4, 1996

[30] Foreign Application Priority Data

Mar. 7, 1995 [DE] Germany ..... 295 04 576.0

[51] Int. Cl.[6] ..... B41J 2/36; B41J 2/37; B41J 2/365

[52] U.S. Cl. ..... 347/194

[58] Field of Search ..... 347/189, 190, 347/194, 185, 14, 19, 50, 60, 119, 130, 132, 237, 238; 400/120.08; 358/298; 219/216

[56] References Cited

U.S. PATENT DOCUMENTS

| | | | |
|---|---|---|---|
| 3,577,137 | 5/1971 | Brenman, Jr. | 347/194 |
| 4,275,402 | 6/1981 | Kern | 347/14 |
| 4,510,507 | 4/1985 | Ishikawa | 347/190 |
| 4,591,876 | 5/1986 | Nozaki et al. | 347/189 |
| 4,955,736 | 9/1990 | Iwata et al. | 347/185 |
| 5,038,154 | 8/1991 | Yamamoto et al. | 347/180 |
| 5,051,756 | 9/1991 | Nomura et al. | 347/189 |
| 5,181,048 | 1/1993 | Cha | 347/186 |
| 5,365,257 | 11/1994 | Minowa et al. | 347/189 |
| 5,453,776 | 9/1995 | Günther et al. | 347/185 |

FOREIGN PATENT DOCUMENTS

| | | |
|---|---|---|
| 0 260 917 | 3/1988 | European Pat. Off. . |
| 0 329 369 | 8/1989 | European Pat. Off. . |
| 0 420 412 A1 | 3/1991 | European Pat. Off. . |
| 0 421 351 A2 | 12/1991 | European Pat. Off. . |
| 0 482 850 | 4/1992 | European Pat. Off. . |
| OS 38 33 746 | 4/1990 | Germany . |
| OS 40 26 896 | 2/1992 | Germany . |
| OS 42 25 798 | 2/1994 | Germany . |
| WO90/03554 | 4/1990 | WIPO . |

*Primary Examiner*—N. Le
*Assistant Examiner*—L. Anderson
*Attorney, Agent, or Firm*—Hill & Simpson

[57] ABSTRACT

A print head thermocontrol includes a combination of power electronics that can be preset with a software potentiometer and that regulates the amplitude of the print head voltage according to the ambient temperature, a control unit operating according to a predictive control method for supplying individual print elements with print pulses and preheating pulses of variable pulse duration and an allocated print control unit for producing a digital imprint.

10 Claims, 3 Drawing Sheets

PRINT HEAD THERMOCONTROL

BACKGROUND OF THE INVENTION

1. Field of the Invention

The present invention is directed to a print head thermocontrol for a thermal printing means of the type composed of a number of print elements, for example, a direct thermal print head, a thermal transfer print head, an ETR print head or an ink jet print head.

2. Description of the Prior Art

Printing devices of the above type can, for example, be advantageously utilized in postage meter machines or in other mail processing machines.

German OS 38 33 746 discloses the pre-heating of an inking ribbon in a printer before printing. The energy required for triggering a printing event is intended to be minimized by pre-heating the printing element to a point close to its printing temperature. As a result, the heating (for printing) and cooling times of the printing element are made short. The variables (pulse height and pulse width) of the clock frequency of the pre-heating pulses can be matched to the required heating energy by comparing a specified temperature to the actual temperature at the overall thermal head. The heated condition of an individual printing element, however, cannot be taken into consideration. A greater safety margin from the printing temperature must be observed to be sure that local temperature differences together with the pre-heating effect an imprint. This increases in importance as fluctuations of the ambient temperature increase.

German OS 40 26 896 discloses that excitation energy be supplied to each printing element dependent on the thermal condition of that printing element in order to be able to implement a printing event with that printing element of the thermal print head. The print head is thermally coupled to a temperature sensor. Correction of the duration of the print pulse is accomplished by account for the time constant of the heat conduction in the print head from the heating elements to the temperature sensor means of the print head. Further, a capacitor circuit is additionally required for simulating the effect of the time constant. The influence of the ambient temperature, however, cannot be simulated therewith.

German OS 39 21 217 discloses a calculation for supplying energy to a printing element of a thermal print head before printing on the basis of a recording energy, a compensation energy and a heat-storing energy. The excitation time or the height of the voltage of the printing pulse is then adjusted on the basis of this calculation. Such a calculation, wherein the energy condition must be taken into consideration before every printing event and new heat storage data must be generated and stored for the following energy condition, must be implemented with additional, complicated hardware otherwise the print head cannot be utilized for higher printing speeds (or less complicated hardware can be used if a slower printing speed is accepted).

European application 329 369 discloses a method for controlling the feed of data to a thermal print head wherein the print data of the preceding and of the current printing events are evaluated in order to identify the heat condition (status) of a print element of the thermal print head. The corresponding print elements are designationally pre-heated, or, a correction heating is implemented after the analysis. Such a subsequent analysis (referred to as historical control) occupies calculating time which would otherwise be available for other purposes. This is always disadvantageous whenever an especially high printing speed is to be achieved.

The influence of the ambient temperature or a change in print head parameters, for example due to aging, are not directly taken into account in any of the aforementioned thermal print head controllers.

A thermal transfer print head as disclosed in European Application 421 353 can be operated in various printing modes. A temperature-measuring element is attached on the head in order to regulate the print energy supplied to the head dependent on the head temperature and dependent on the head stress (print mode). The pulse width is reduced with increasing head temperature without having to utilize data processing (historical control) for pre-heating pulses, or for heating pulses. The method therefore operates less precisely than a method with historical control, so that only a combination of the two allows the required precision to be achieved. The disadvantage of time-consuming data processing thus reoccurs.

Disadvantages of these temperature-measuring elements are, first, that they still respond too slowly to temperature changes (caused by the thermal storing of the head), and second, that the application of the thermal element (such as a thermistor) on the head means an additional outlay. Moreover, influences of the ambient temperature are acquired only via the head temperature, even though ambient temperature changes influence the inking ribbon in a way which degrades the print quality, but without being so severe as to trigger a printing event.

Energy supply according to the aforementioned method disclosed in European Application 421 353, i.e. reduced energy delivery with increasing temperature, degrades the printing quality to a rather significant extent since the inking ribbon tends to smear given an inadequately pre-heated print head and a high ambient temperature, especially when operation is undertaken in the so-called "saving mode", as proposed in German OS 42 25 798. Moreover, the maximally obtainable printing speed is already upwardly limited by the range of variation of the heating pulse duration.

German OS 41 33 207 discloses a method for controlling the data feed of a thermal printing heating element wherein the print data for a number of future printing columns are taken into account in order to selectively calculate a number of pre-heating pulses therefrom for each print element before printing. The thermal print head controller has no temperature measuring means of any kind.

European Application 279 637 proposes the use of a second thermistor in the proximity of the air admission opening for determining the temperature of the ambient air of the device. As is the information about the head temperature, this information is supplied to a microprocessor that reduces the energy supply to the print head in conformity with increasing ambient temperature. The divergence in the characteristics of the two thermistors is problematical for a more exact calculation.

German OS 32 36 150 discloses a control element for a thermal transfer printer for controlling the feed currents from the thermohead driver unit dependent on the ambient temperature. A thermistor is preferably connected into the feed voltage lead to the print head.

The thermistor has a temperature characteristic that corresponds to that of the inking ribbon. The feed currents thus change in a specific relationship to the ambient temperature in a simple way. Energy for printing is lost due to the voltage drop across the thermistor in the feed voltage lead. The efficiency is especially reduced for high-resolution print heads, i.e. having many dots. Moreover, a fluctuation of the print format dependent on the content of the print image cannot be corrected using this known approach.

SUMMARY OF THE INVENTION

An object of the present invention is to provide a technical solution for electronic thermocontrol of print heads wherein the aforementioned disadvantages of known systems are avoided and that can be economically realized.

The various causes necessitating the use of a thermocontrol arrangement for a multiple print element print head arise from the conditions that influence the imprinting. It is presumed that a control means, usually a microprocessor, is present in the system for electronically operating the print head, this control means being also supplied with other data in addition to the current machine parameters and print image data.

The inking ribbon or the recording medium has a far lower heat capacity than the print head and, consequently, reacts faster to temperature fluctuations. It was found that a temperature measurement on the print head can be advantageously eliminated and that, moreover, a significantly faster response time is assured when the ambient temperature measurement is not thermally coupled to the temperature sensor, by contrast to temperature sensors conventionally utilized on the print head.

The inventive solution of the object is that the print head thermocontrol is formed by a combination of power electronics allocated to a print control unit, this power electronics regulating the amplitude of the print head voltage in conformity with the ambient temperature, and a control unit that operates with a predictive control method for feeding individual print elements with printing pulses and with pre-heating pulses of a variable pulse duration.

A temperature sensor can be provided in a known way for monitoring slow temperature changes of the ambient temperature, this being economically arranged in the proximity of the power electronics and existing aeration (ventilation) slots in order to control the pulse duration. It is also provided that, decoupled therefrom, the total energy (that is unambiguously defined by the image data) sent to the print head is evaluated predictively by the microprocessor over predetermined time windows and is matched, dependent on the supplied printing energy, to the anticipated temperature curve at the head.

In a predictive control method, future control parameters are advantageously calculated, so that the expected influences due to changes in temperature remain relatively slight. The repetitive error thus stays small and large fluctuations in the control are avoided, i.e. overshooting does not occur.

By storing pre-set parameters, instead of a hardware potentiometer a so-called software potentiometer is used. Such a software potentiometer can be set by a service technician via actuation means on the keyboard in the service mode without having to open the postage meter machine for that purpose.

In a version of the print head thermocontrol according to the invention for a print head that has a plurality of print elements, the print head is connected to power electronics and to a printer control unit, the printer control unit being coupled to input means and to output means via an I/O controller, as well as to memory means. The power electronics regulates the amplitude of the print head voltage in proportion to the measured temperature and is allocated to the printer control unit. A plurality of print elements are driven by the microprocessor of the control unit according to a predictive control method. Means for electronically presetting the amplitude of the print head voltage and for supplying control parameters are provided. The means for electronic presetting include memory means, the microprocessor of the control unit, an I/O controller and actuation means of the connected input means, and power electronics connected to the microprocessor of the control unit. This power electronics includes a digital-to-analog converter and a control circuit. The presetting voltage can be set with actuation means of the input means in the service mode according to the print head parameters required for a particular customer, and the setting can be non-volatilely stored in the memory means (occupying only a part or region thereof).

DESCRIPTION OF THE PREFERRED EMBODIMENTS

Figure 1:
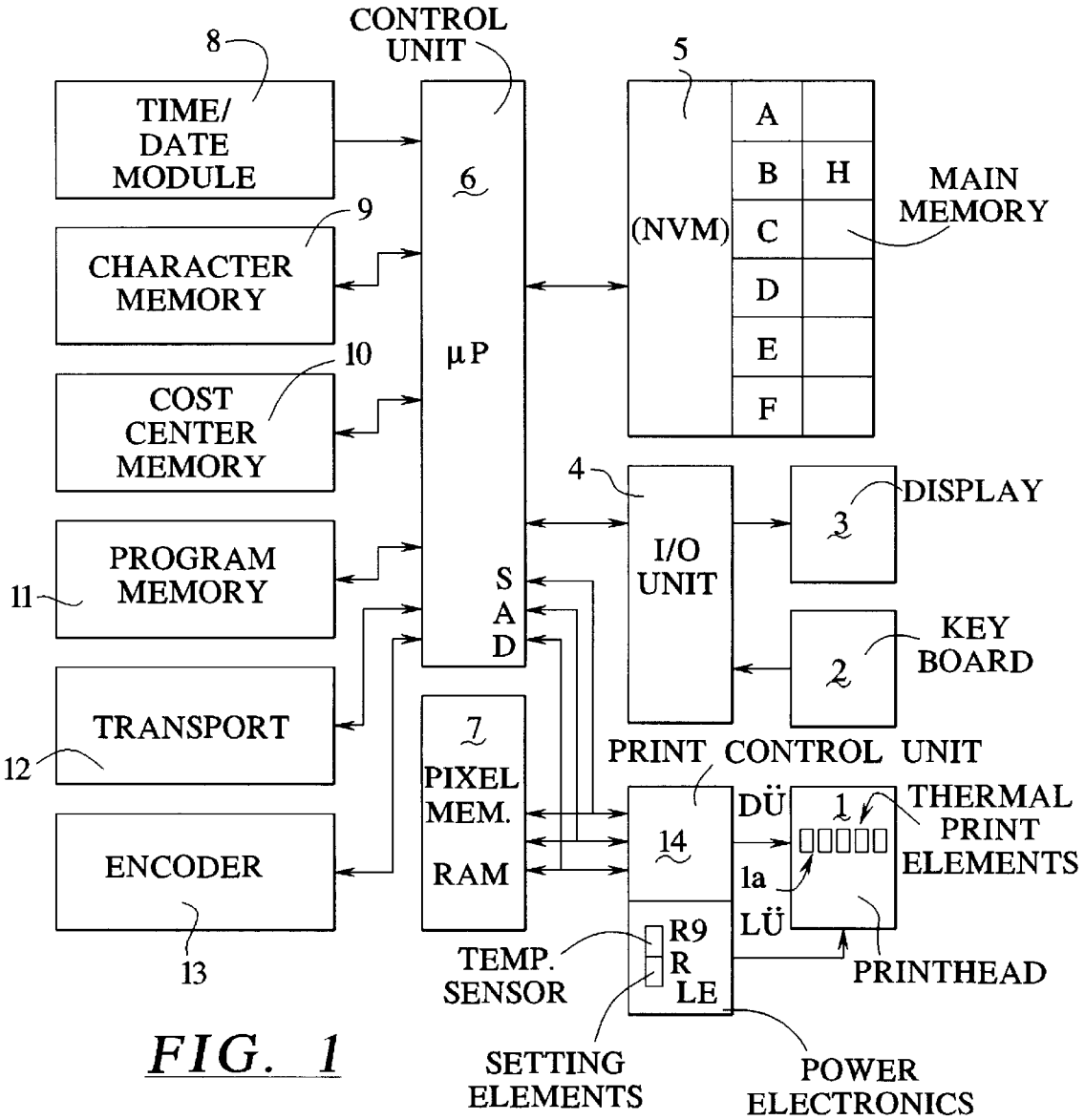
FIG. 1 is a block circuit diagram of a postage meter machine with the inventive print head thermocontrol.

FIG. 1 shows a block circuit diagram of a postage meter machine with the inventive print head thermocontrol. For example, a direct thermal print head, a thermal transfer print head, ETR or ink jet print head 1 with an associated print control unit 14 can be employed as printer means for the postage meter machine. This print control unit 14 serves the purpose of driving (schematically indicated) print elements 1*a* of the print head 1 for making a digital imprint.

The print control unit 14 is in communication with the print head 1 for data transfer via lines DÜ and is also in communication with power electronics LE for power transmission via lines LÜ. For simplicity, only one line has been shown.

The arrangement further includes a control unit 6 connected to input/output units, such as a keyboard 2 and a display 3 via an I/O stage 4. The control unit 6 is also connected to a volatile memory 7 and to non-volatile memory units including a main memory 5 having dedicated memory areas A–H, a time/date module 8, a character memory 9, a cost center memory 10 and a program memory 11. The control unit 6 operates according to a predictive control method without a need for a direct temperature measurement on the print head 1. The control unit 6 is also connected to an encoder 13 serving as a path sensor and to an article or tape transport 12 for moving postal matter in the form of individual items, or for advancing paper tape from a tape dispenser past the print head 1. The individual print columns are printed on the article or tape dependent on the conveying speed thereof until the franking format is completed. The pixel data for the invariable (constant) image parts of the franking image are stored in the program memory 11 in addition to the operating program. The variable pixel data of the franking image, which are transferred into the non-volatile main memory 5 in conformity with an entry made via a keyboard 2, are stored in the character memory 9. The time/date module 8 supplies further input data for the franking image, for which pixel data are generated in the same way. The fully compiled pixel image is temporarily stored in the volatile memory 7 and is evaluated in predictive fashion by the control unit (microprocessor) 6. For example, the volatile memory 7 may be a RAM module or an internal RAM of the microprocessor forming the control unit 6.

The control unit 6 reads out the pixel image data from the volatile memory 7 and processes these data in order to supply print image data to the print control unit 14 according to the predictive control method being employed. The corresponding operating program is thereby stored in the program memory 11.

This operation is preferably carried out according to the predictive control method of German OS 41 33 207. When a print event is to be triggered with a print element in the near future, then, as preparation for the print event, the particular print element is already charged with pre-heating current pulses at times wherein it does not contribute to the printing. The energy content of the pre-heating pulses is thereby continuously incremented, and thus, a high printing speed is achieved. As a result of the aforementioned anticipation of the future printing data, less calculating time is used during printing when the calculation already begins before the printing event of the overall franking imprint.

Normally, thus, no temperature sensor is required on the print head for the operation of a thermal transfer print head in order to monitor and compensate for large temperature fluctuations because the controller works with sufficient precision.

This, however, does not preclude the optional, additional switching (not shown) of the heating pulse height given very high heating of the print head, for the protection of the print head. A second thermistor (relatively expensive thermistor capsule) arranged at the print head in a known way would then be used. Practice has shown, however, that print heads are so dependably manufactured that such protection generally can be foregone.

An inexpensive structure can thus be utilized for the thermistor that only acquires the ambient temperature, instead of an expensive thermistor capsule because the arrangement is not disposed on the print head. The advantage of the inventive solution, that the thermistor need not be placed directly on the print head, arises from the use of the aforementioned predictive control method. Moreover, the invention succeeds in reducing the thermal storage elements of the measuring arrangement with the temperature sensor while still achieving an adequately fast readjustment, given a change in ambient temperature, without overshooting. Additionally, both the type of ribbon employed, or the grade of paper employed, given direct thermal printing can be more simply taken into account as a further influencing variable.

An underlying, slow control of the amplitude of the print pulses for slow changes in the ambient temperature and a superimposed, extremely fast and exact temperature control operating predictively dependent on the current print image content and the overall energies of the system connected therewith are thus advantageously combined, and the outlay for circuits and components is reduced further.

Figure 2:
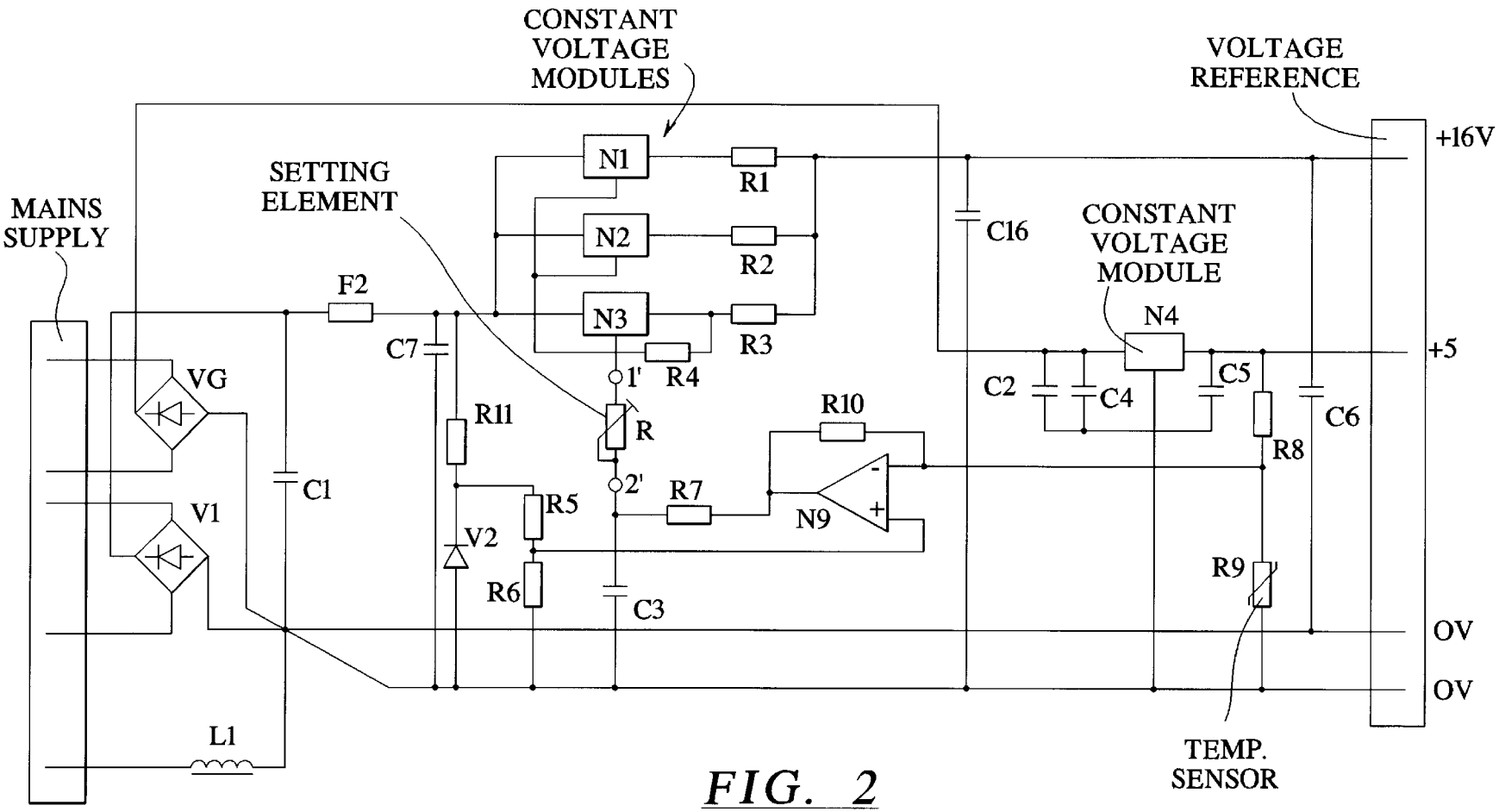
FIG. 2 is a circuit diagram of the power electronics of the inventive print head thermocontrol.

FIG. 2 shows the power electronics LE with the temperature sensor R9 for temperature-dependent adaptation of the amplitude of the print pulse voltage. The power electronics LE includes full-wave rectifier bridges V1 and V6 connected to a mains supply, and filter elements L1, C1 and F2. Different control behaviors can be realized by suitable dimensioning of the components associated with temperature sensor R9. The measuring arrangement can be arranged in the proximity of the associated electronics and thus cost savings can be achieved such as by the elimination of leads and plug-type connections.

The power electronics includes a voltage divider formed by resistors R8 and R9 for the measurement of the ambient temperature, the resistor R9 serving as the temperature sensor, the center tap thereof being connected to the inverting input of a proportional regulator N9. The non-inverting input of the proportional regulator N9 is connected to a reference voltage source formed by a voltage divider R5, R6 connected across a Zener diode V2, that is connected in series with a resistor R11 across capacitor C7. The proportional regulator N9 is also connected to the control input of at least one constant voltage module N1,N2, and/or N3.

The resistor R9 serving as the temperature sensor is a thermistor and that the voltage divider R8,R9 is supplied with a second constant voltage from a second constant voltage module N4.

The control input of the at least one constant voltage module N1,N2, and/or N3 is connected to a setting element R connected across terminals 1' and 2'. Given a defined temperature, the amplitude of the print pulse voltage is set to a value, for example +16 V developed across capacitor C16 and C6 in the thermal transfer printing method, with the setting element R. The constant voltage modules N1,N2, and N3, are respectively connected at their output side to current-dividing resistors R1,R2, and R3 (a further resistor R4 being connected across the constant voltage module N3). The output of the proportional regulator N9 is connected to the setting element R, preferably an adjustable rheostat, via an RC element R7,C3 and is in addition connected via R10 to an inverting input connected to the tap of the voltage divider R8,R9 (which contains the thermistor R9). A constant voltage module N4, with the associated capacitors C2, C4, C5, delivers the +5 V supply voltage required for the electronics. The other, non-inverting input of the regulator N9 lies at reference potential at the center tap of a further voltage divider formed by resistors R5, and R6.

The superimposed, fast temperature control by the microprocessor is dependent on various system parameters (such as, for example, printing speed, printing mode). Supplied with this information, the microprocessor (control unit 6) can realize arbitrary control curves and arbitrary control behavior.

In an advantageous modification, the setting element R is a D/A converter driver by the control unit 6. Alternatively, the setting element can contain a resistor arrangement that can be switched by the microprocessor.

Figure 3:
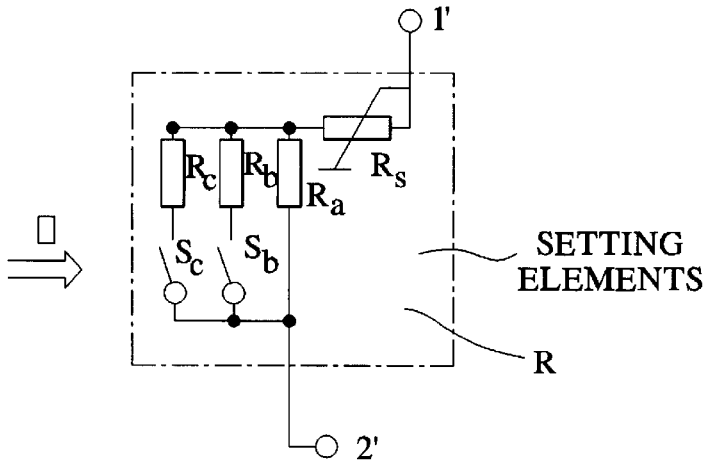
FIG. 3 is a schematic diagram of a resistor arrangement in the inventive print head thermocontrol that can be switched by the microprocessor.

FIG. 3 shows such a resistor arrangement switchable by the microprocessor (control unit 6). The resistors Rb and Rc can thus be cut in with the switches Sb and Sc via the data D according to the desired presetting of the first constant voltage. The overall resistance Rges can be selected from four combinations, respectively amounting to:

(case a): Rges=Rs+Ra (case b): Rges=Rs+Ra||Rb (case c): Rges=Rs+Ra||Rb||Rc (case d): Rges=Rs+Ra||Rc.

The ribbon speed or the printing speed can thus be taken into consideration, or a basic contrast can be set for the print image. The required data D for setting the basic contrast are stored non-volatilely in the memory area H of the main memory 5 and can be entered via the keyboard 2.

Figure 4:
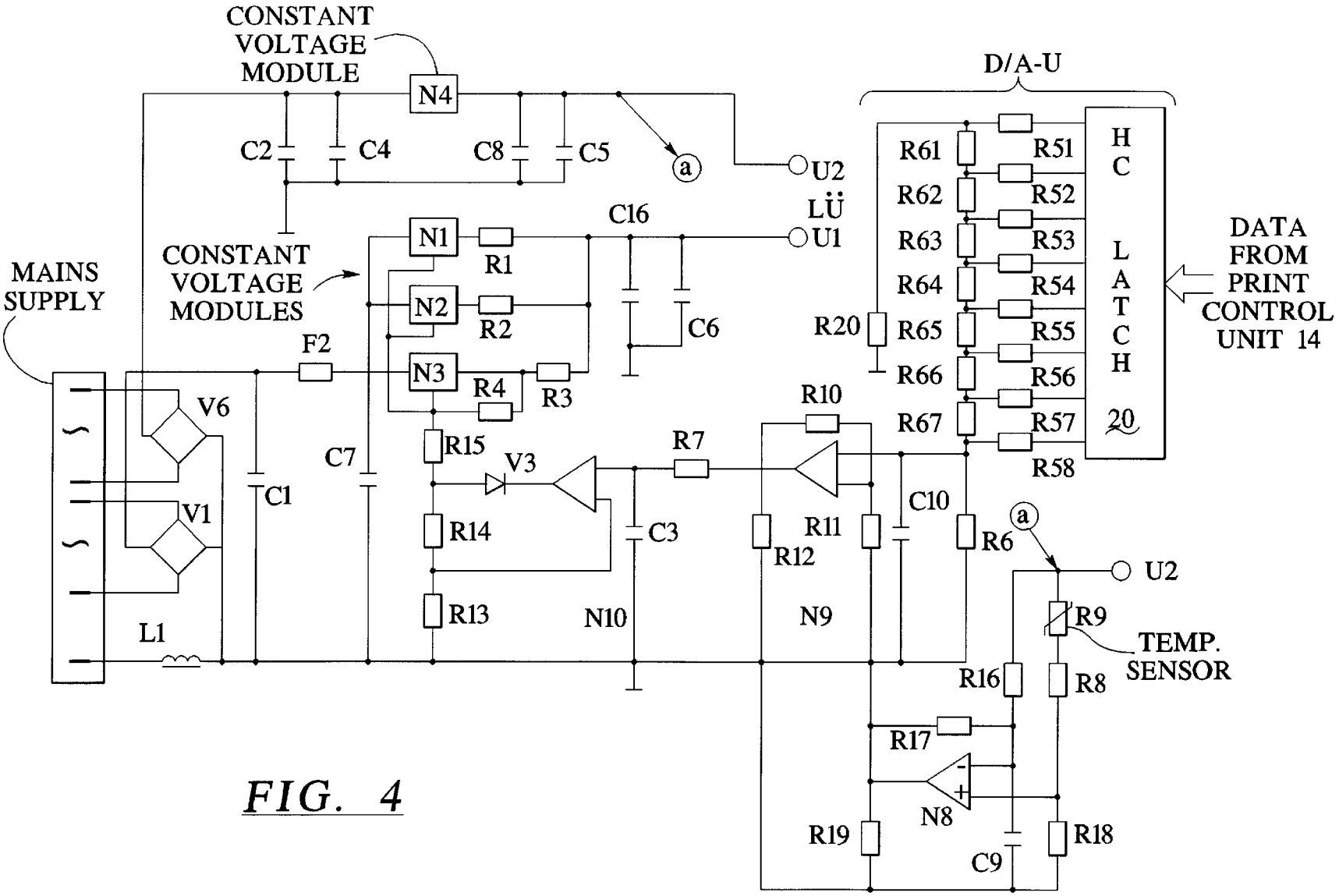
FIG. 4 is a circuit diagram of a further modification of the inventive print head thermocontrol with a software potentiometer.

FIG. 4 shows a further circuit modification with which an electronic pre-setting of the voltage value can be realized with a digital-to-analog converter (DAU). Such a circuit is also referred to as a software potentiometer.

The postage meter machine can be switched into a service mode. The preset voltage value can be raised or lowered dependent on the actuation of a corresponding actuation means, preferably a key for an up function and a key for a down function on the keyboard 2. The digital-to-analog converter DAU is composed, for example, of an HC latch 20 controllable by the microprocessor (control unit 6) and an R2R resistor network R51 through R58 and R61 through R67. The aforementioned R2R resistor network, which forms a voltage divider together with a resistor R6 connected to ground potential, converts the DAU output currents into a pre-setting voltage that is present at the non-inverting input of the regulator N9.

This voltage can be converted, for example, if the converter DAU is an 8-bit converter with a step width of 0.01 V. The aforementioned regulator N9 is connected as a subtracting amplifier. The output voltage of a temperature sensor test amplifier N8 is supplied to its inverting input. The non-inverting input (+) of a non-inverting setting amplifier stage N10 (including diodes V3, and resistors R13 and R14) is connected to the output of the regulator N9 via an RC element R7, C3. The output of the setting amplifier stage N10 is supplied to the control input of the at least one constant voltage module N1,N2, or N3 via the resistor R15. In the circuit of the temperature sensor test amplifier NB, an NTC thermistor having a negative temperature coefficient serves as the temperature sensor R9, this forming a voltage divider together with a drop resistor R8 and a base impedance R18 that supplies a ground terminal, whereby the thermistor R9 of the voltage divider is supplied with a second constant voltage U2 from a second constant voltage module N4. The voltage divider center tap is connected to the non-inverting input of the temperature sensor test amplifier N8 and is stabilized with a capacitor C9 connected in parallel with the base impedance R18. With increasing temperature, the center tap of the voltage divider delivers a rising voltage to the non-inverting input of the temperature sensor test amplifier N8, whose output voltage rises. The output voltage of the temperature sensor test amplifier N8 is subtracted from the presetting voltage, and thus the control voltage is lowered. A first voltage U1 that allows the required print voltage amplitude to be generated is thus generated at the output of the at least one constant voltage module N1,N2,and N3.

The second constant voltage module N4 delivers a second voltage U2, for example the +5 V supply voltage required for the print head electronics.

The power electronics is in communication with the print head electronics (not shown in detail in FIG. 1) of the print head 1 that generates print voltage pulses according to the drive by the print control unit DS. Such a print head electronics of the print head 1 contains at least the driver gates for charging the individual print elements of the print head 1 with data from the print control unit DS via data transfer lines DÜ and with energy, for example first and second voltages U1 and U2, from the power electronics LE via power transmission lines LÜ.

Given a different temperature sensor, a different circuit can be selected for the temperature sensor test amplifier in order to amplify the voltage before it is conducted to the regulator. The regulator adds a negative voltage to the presetting voltage or subtracts a positive voltage from the presetting voltage dependent on the type of circuit selected. Dependent on a parameter, for example on the impedance of a thermal transfer print head, the control voltage is set by at least one constant voltage module N1,N2, or N3 with the presetting voltage.

The power electronics LE shown in FIG. 4 can also be expanded by a switch means and by a comparator that can be interrogated by the control unit 6. The switch means (not shown) is provided in order either to deactivate or to bridge the temperature sensor. A comparator (not shown) then compares the print voltage U1 to an exact reference voltage and an offset for the DAU is thus calculated. This offset is provided during manufacture and can be repeated by the customer in order to compensate for drift.

Although modifications and changes may be suggested by those skilled in the art, it is the intention of the inventors to embody within the patent warranted hereon all changes and modifications as reasonably and properly come within the scope of their contribution to the art.

We claim as our invention:

1. A thermocontrol for a print head for use with an electrical power mains, said print head having a plurality of individually actuatable thermal print elements, said thermocontrol comprising:

print control means connectible to said print head for generating print control pulses for activating selected thermal print elements of said print head to produce an imprint;

power electronic means for connecting said electrical power mains to said print head for measuring an ambient temperature and for regulating an amplitude, dependent on said ambient temperature, of a print head voltage supplied to said print head, said power electronic means comprising a voltage divider containing a resistive temperature sensor for measuring said ambient temperature, said voltage divider having a center tap, a proportional regulator having a non-inverting input connected to said center tap of said voltage divider and having an inverting input connected to a reference potential, and at least one constant voltage module having a control input connected to an output of said proportional regulator; and control means, connected to said power electronic means, employing a predictive method for generating pre-heating pulses and for supplying said pre-heating pulses to said print control means for controlling said power electronic means to individually pre-heat said thermal print elements according to said pre-heating pulses.

2. A thermocontrol as claimed in claim 1 wherein said resistive temperature sensor comprises a thermistor, and said power electronics means comprising a further constant voltage module connected across said voltage divider which maintains a constant voltage across said voltage divider.

3. A thermocontrol as claimed in claim 1 wherein said power electronics means further comprises setting means for setting an amplitude of said print head voltage, said setting means being connected to said control input of said at least one constant voltage module.

4. A thermocontrol as claimed in claim 3 further comprising an RC element, said proportional regulator being connected to said control input of said at least one constant voltage module via said RC element and via said setting means.

5. A thermocontrol as claimed in claim 3 wherein said setting means comprises a digital-to-analog converter controlled by said control means.

6. A thermocontrol as claimed in claim 3 wherein said setting means comprises a resistor network switchable to different resistor values by said control means.

7. A thermocontrol for a print head for use with an electrical power mains, said print head having a plurality of individually actuatable thermal print elements, said thermocontrol comprising:

print control means connectible to said print head for generating print control pulses for activating selected thermal print elements of said print head to produce an imprint;

power electronic means for connecting said electrical power mains to said print head for measuring an ambient temperature and for regulating an amplitude, dependent on said ambient temperature, of a print head voltage supplied to said print head; and control means, connected to said power electronic means, employing a predictive method for generating pre-heating pulses and for supplying said pre-heating pulses to said print control means for controlling said power electronic means to individually pre-heat said thermal print elements according to said pre-heating pulses;

setting means comprising a digital-to-analog converter operated by said control means, for presetting said print head voltage to a customized value;

input means connected to said control means for manually entering said customized value; and non-volatile memory means, connected to said input means and accessible by said control means, for non-volatilely storing said customized value.

8. A thermocontrol as claimed in claim 7 wherein said power electronics means comprises:

a voltage divider containing a resistive temperature sensor for measuring said ambient temperature and having a center tap;

a temperature test amplifier having a non-inverting input connected to said center tap of said voltage divider;

a proportional regulator having an inverting input connected to and output of said temperature test amplifier via a resistor, said proportional regulator having a non-inverting input connected to said digital-analog converter and supplied by said customized value;

a non-inverting setting amplifier network and a further resistor; and least one constant voltage module having a control input connected to and output of said proportional regulator via said setting amplifier and said further resistor.

9. A thermocontrol as claimed in claim 8 wherein said resistive temperature sensor comprises a thermistor, and said power electronics means comprising a further constant voltage module connected across said voltage divider which maintains a constant voltage across said voltage divider.

10. A thermocontrol as claimed in claim 8 further comprising an RC element, and said output of said proportional regulator being connected to said setting amplifier via said RC element.

* * * * *